US008059041B2

(12) United States Patent
Chang

(10) Patent No.: US 8,059,041 B2
(45) Date of Patent: Nov. 15, 2011

(54) DIAMOND-SHAPED ANTENNA RECEIVING DEVICE

(75) Inventor: Ming Wen Chang, Kowloon (HK)

(73) Assignee: San Wen (H.K.) International Co., Ltd., Kowloon (HK)

( * ) Notice: Subject to any disclaimer, the term of this patent is extended or adjusted under 35 U.S.C. 154(b) by 253 days.

(21) Appl. No.: 12/477,933

(22) Filed: Jun. 4, 2009

(65) Prior Publication Data

US 2010/0309062 A1 Dec. 9, 2010

(51) Int. Cl.
*H01Q 1/24* (2006.01)
*H01Q 1/22* (2006.01)

(52) U.S. Cl. ..... 343/702; 343/741; 343/742; 343/866; 343/867

(58) Field of Classification Search ..... 343/702, 343/718, 769, 784, 907, 782
See application file for complete search history.

(56) References Cited

U.S. PATENT DOCUMENTS

| | | | | |
|---|---|---|---|---|
| 6,573,874 | B1 * | 6/2003 | Saito et al. | 343/805 |
| 7,646,345 | B2 * | 1/2010 | Takisawa et al. | 343/700 MS |
| 2008/0055184 | A1 * | 3/2008 | Noro et al. | 343/872 |
| 2010/0285758 | A1 * | 11/2010 | Laidig et al. | 455/90.3 |

* cited by examiner

*Primary Examiner* — Jacob Y Choi
*Assistant Examiner* — Amal Patel
(74) *Attorney, Agent, or Firm* — Leong C. Lei

(57) ABSTRACT

An antenna device includes an enclosure defining a receiving compartment and having a back forming a mounting seat for mounting to a fixture and an end forming a connector for connection with a coaxial cable. A reflection case, which is received in the enclosure, includes reflection plates set around the case and has a bottom stamped to form partially cut tabs that are bent upward by an angle of approximately 90 degrees. The diamond-shaped antenna is composed of two quadrilateral antenna boards received in the reflection case and fixed to the bent tabs and has a central portion to which a waveguide is coupled for connection with the connector of the enclosure through a coaxial cable. The enclosure is closed by a cover plate to protect the diamond-shaped antenna from direct exposure to severe weather.

2 Claims, 6 Drawing Sheets

DIAMOND-SHAPED ANTENNA RECEIVING DEVICE

(a) TECHNICAL FIELD OF THE INVENTION

The present invention generally relates to a novel structure of a diamond-shaped antenna receiving device, which comprises an enclosure in which a reflection case is set to accommodate a diamond-shaped antenna of which a central portion is coupled to an antenna waveguide, whereby with reflection plates set around the reflection case, the receiving angle is made wider and the stability is improved and especially good in receiving UHF signal by providing a high gain.

(b) DESCRIPTION OF THE PRIOR ART

An antenna device is a must for watching TV programs, unless cable TVs are used. The antenna must be properly installed in order to receive wireless signals of TV programs. TV antennas are classified as indoor antennas and outdoor antennas. A conventional indoor antenna is illustrated in FIG. 1 of the attached drawings, comprising a circuit board 1 that has a central portion forming a circuit pattern zone 11 and two opposite side portions on which receiving plates 111 are respectively provided. The receiving plates 111 and the circuit pattern of the circuit pattern zone 111 are both printed on the circuit board 1. UHF signals are received through the receiving plates 111, while VHF signals are received through copper strips 112 connected to the circuit pattern zone 11. The whole structure is simple. However, although the conventional circuit board 1 is of quite a size, the circuit pattern zone 11 only occupies a small fraction of the central portion and the receiving plates 111 on the opposite side portions take the most portion of the circuit board. This increases the manufacturing costs for the costs of printed circuit boards are calculated on the basis of the size thereof. Further, the indoor antenna often suffers dead zone in receiving signals due to buildings or other factors, so that the performance of signal receiving is poor or is susceptible to interference.

The outdoor antenna provides performance of signal receiving that may effectively eliminate the problem and much better signal receiving can be realized for mountain areas or areas where signal quality is poor. However, the conventional outdoor antenna is often of a fish-bone configuration comprising a frame to which aluminum tubes are mounted in a parallel manner. A wire box is provided to connect to the antenna and a signal cable extends from the wire box to a TV set for supply the received signals to the TV. The antenna must be installed at quite a height by being mounted to a post or other high fixture. The conventional outdoor antenna must be properly aligned to a signal source in order to have a good receiving performance. Further, the outdoor antenna is exposed to the severe weather, and this makes it easy to get damaged or the aluminum tubes fall. The receiving performance usually gets worse when weather is poor.

In view of the problems, the present invention aims to provide an antenna device that overcomes these problems.

SUMMARY OF THE INVENTION

The present invention provides a novel structure of an outdoor antenna receiving device, and in particular a novel structure of diamond-shaped antenna that has a wide receiving angle and improved stability, which is composed of an enclosure, a reflection case, a diamond-shaped antenna, and a cover plate. The enclosure forms a hollow container defining a receiving compartment for receiving therein the reflection case. The enclosure has a back to which a mounting seat is provided for mounting to a fixture and an end forming a connector for connection with a coaxial cable. The reflection case is composed of reflection plates and has a bottom which is stamped to form partially cut tabs that are bent upward by an angle of approximately 90 degrees. The diamond-shaped antenna is composed of two quadrilateral antenna boards and is received in the reflection case and fixed to the bent tabs. The diamond-shaped antenna has a central portion to which a waveguide is coupled and the waveguide is connected to the connector of the end of the enclosure through a coaxial cable. The enclosure is closed by a cover plate to protect the diamond-shaped antenna from direct exposure to severe weather, so as to not only ensure water sealing but also provide a wider receiving angle and better stability and realize high gain signal receiving particularly for UHF signals.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
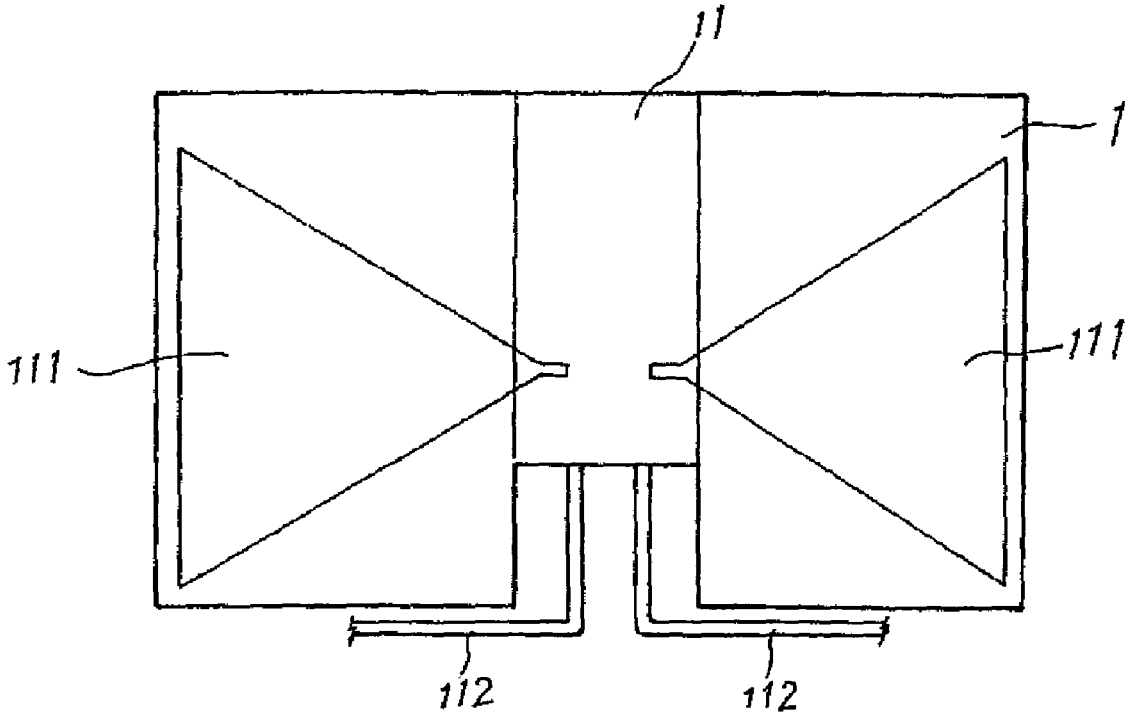
FIG.1 PRIOR ART
FIG. 1 is a schematic view showing a conventional indoor antenna circuit board.
Figure 2:
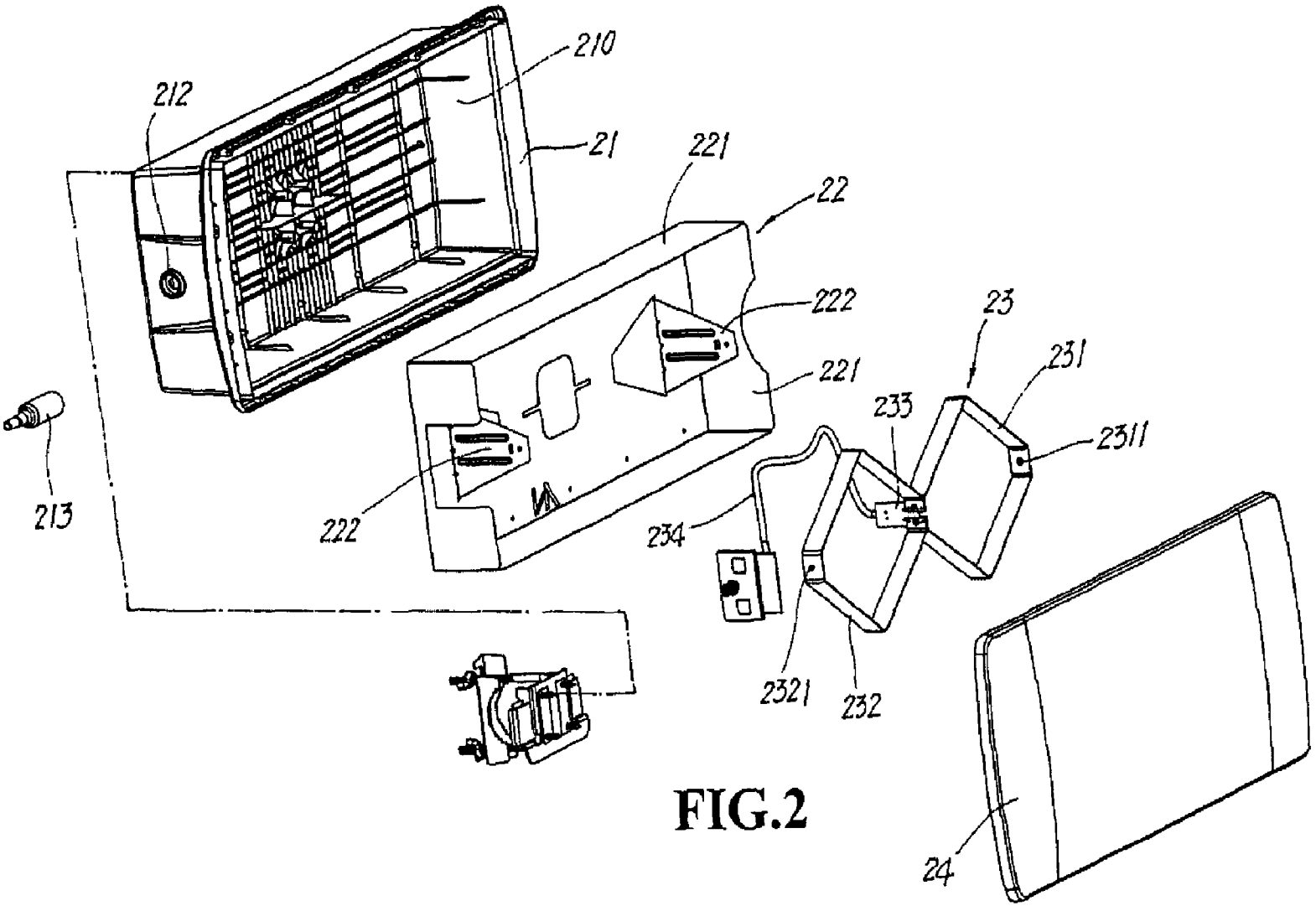
FIG. 2 is an exploded view of the present invention.
Figure 3:
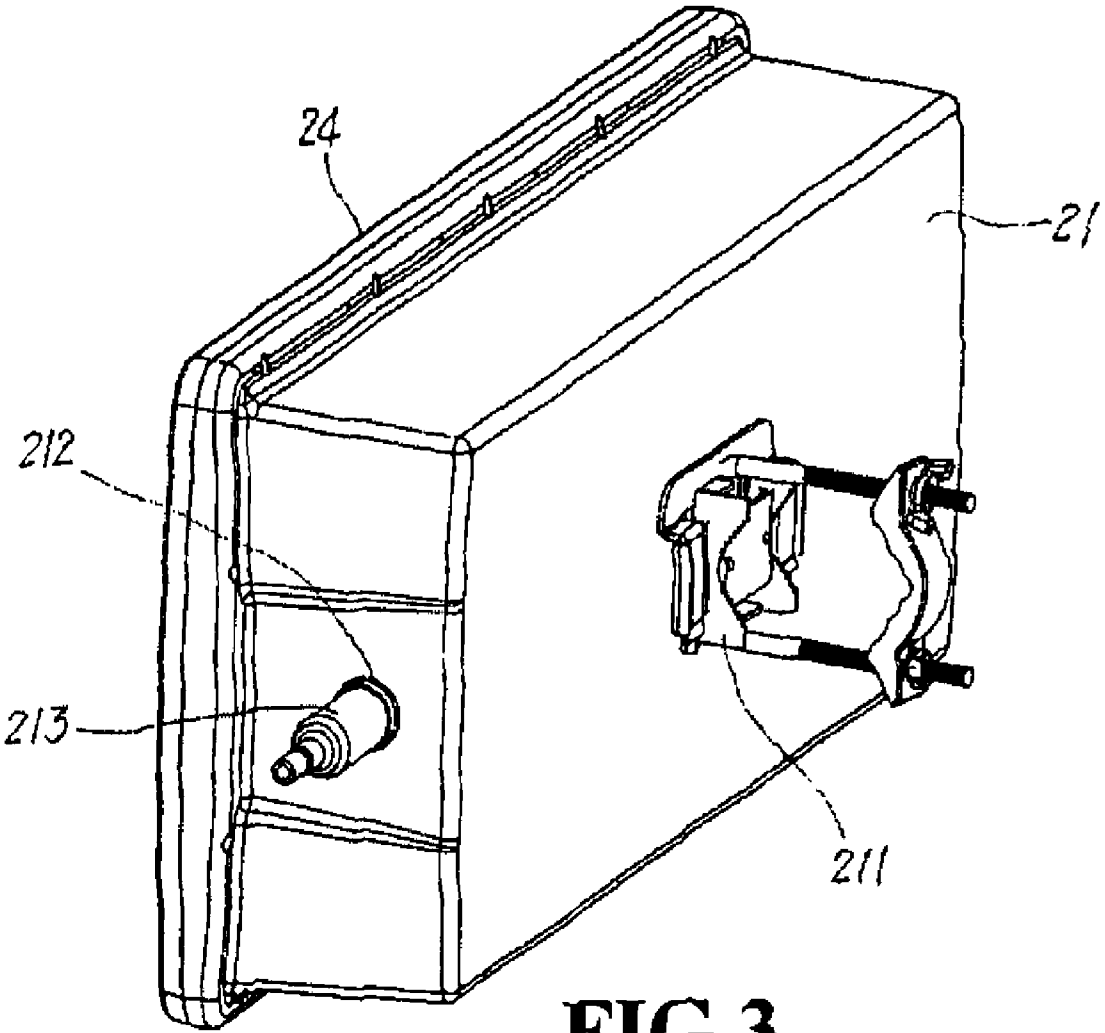
FIG. 3 is a perspective view of the present invention.

With reference to FIG. 2, which shows an exploded view of the present invention, the present invention provides an antenna device, generally designated at 2, comprising an enclosure 21, a reflection case 22, a diamond-shaped antenna 23, and a cover plate 24. The enclosure 21 forms a hollow container defining a receiving compartment 210 and has a back to which a mounting seat 211 is provided and a lower end forming a connector 212 for a coaxial cable and fit with a water-proof sheath 213. The reflection case 22 is received in the receiving compartment 210 and has a circumference forming surrounding reflection plates 221 and a bottom which is stamped to form partially cut line so as define partially cut tabs 222. The tabs 222 are bent upward by an angle of approximately 90 degrees and thus define openings in the bottom of the reflection case 22. The diamond-shaped antenna 23 is formed by composing two quadrilateral antenna boards 231, 232 together and forms positioning hole 2311, 2321 in opposite sides thereof for coupling with the bent tabs 222. The diamond-shaped antenna 23 has a central portion where the quadrilateral antenna boards joined to each other and a waveguide 233 is coupled to the central portion. The waveguide 233 is connected to a terminal member 212 through a cable 234. The cover plate 24 is put over to cover and close the enclosure 21. Referring first to FIG. 3, to assemble, the reflection case 22 is put into the receiving compartment 210 of the enclosure 21 and then fixed. The diamond-shaped antenna 23 is positioned into the reflection case 22 and the two sides of the quadrilateral antenna boards 231, 232 are set to abut the bent tabs 222 and fixed thereto. The cover plate 24 is the put to close the enclosure 21. This completes the assembling of the present invention. The mounting seat 211 provided on bottom of the enclosure 21 can be secured to for example a post through bolting (this being well known and not further discussed). The connector 212 is fit with a water-proof sheath 213 so that the enclosure 21 is completely water proof.

Figure 4:
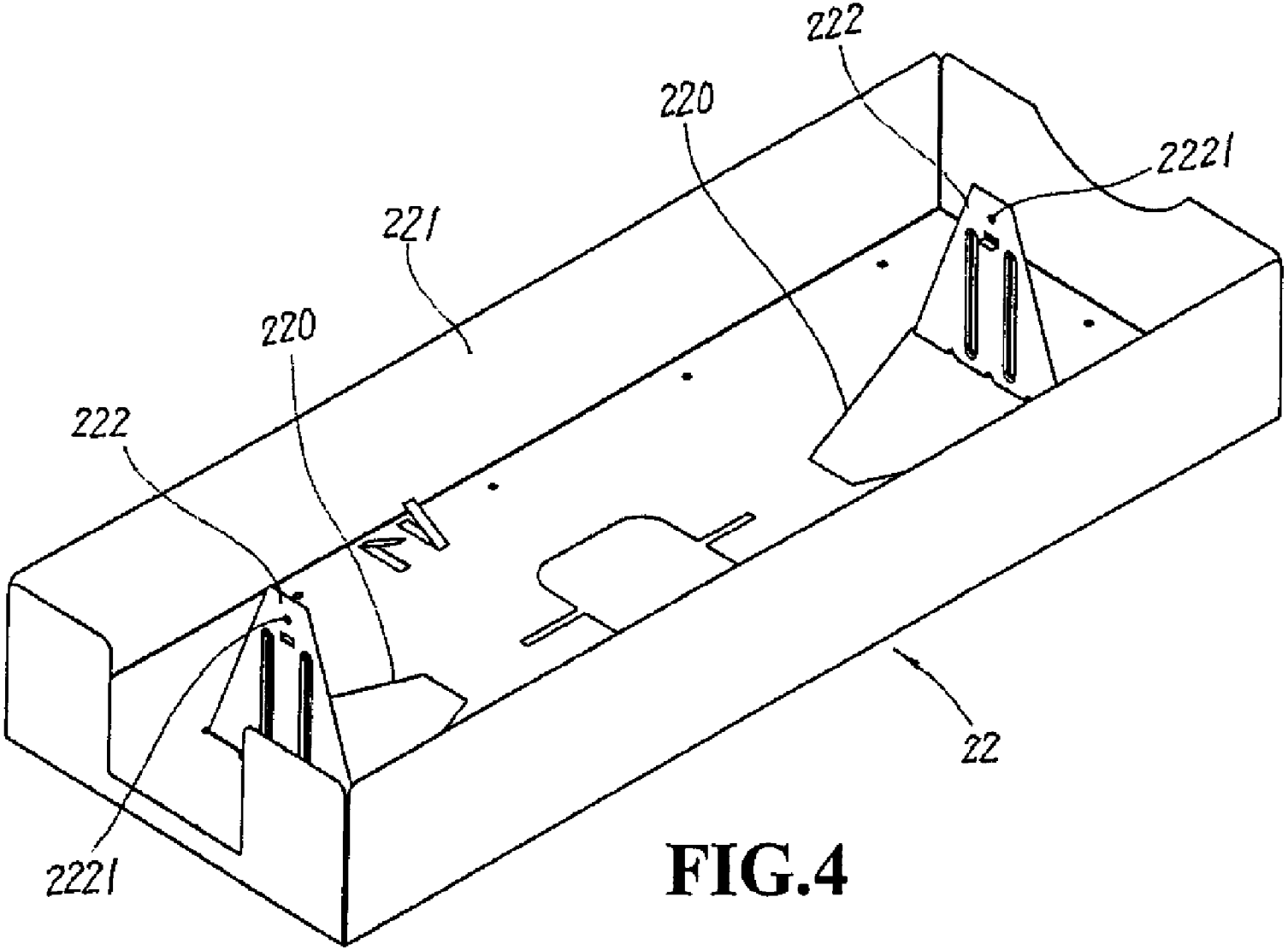
FIG. 4 is a perspective view showing a reflection case in accordance with the present invention.
Figure 5:
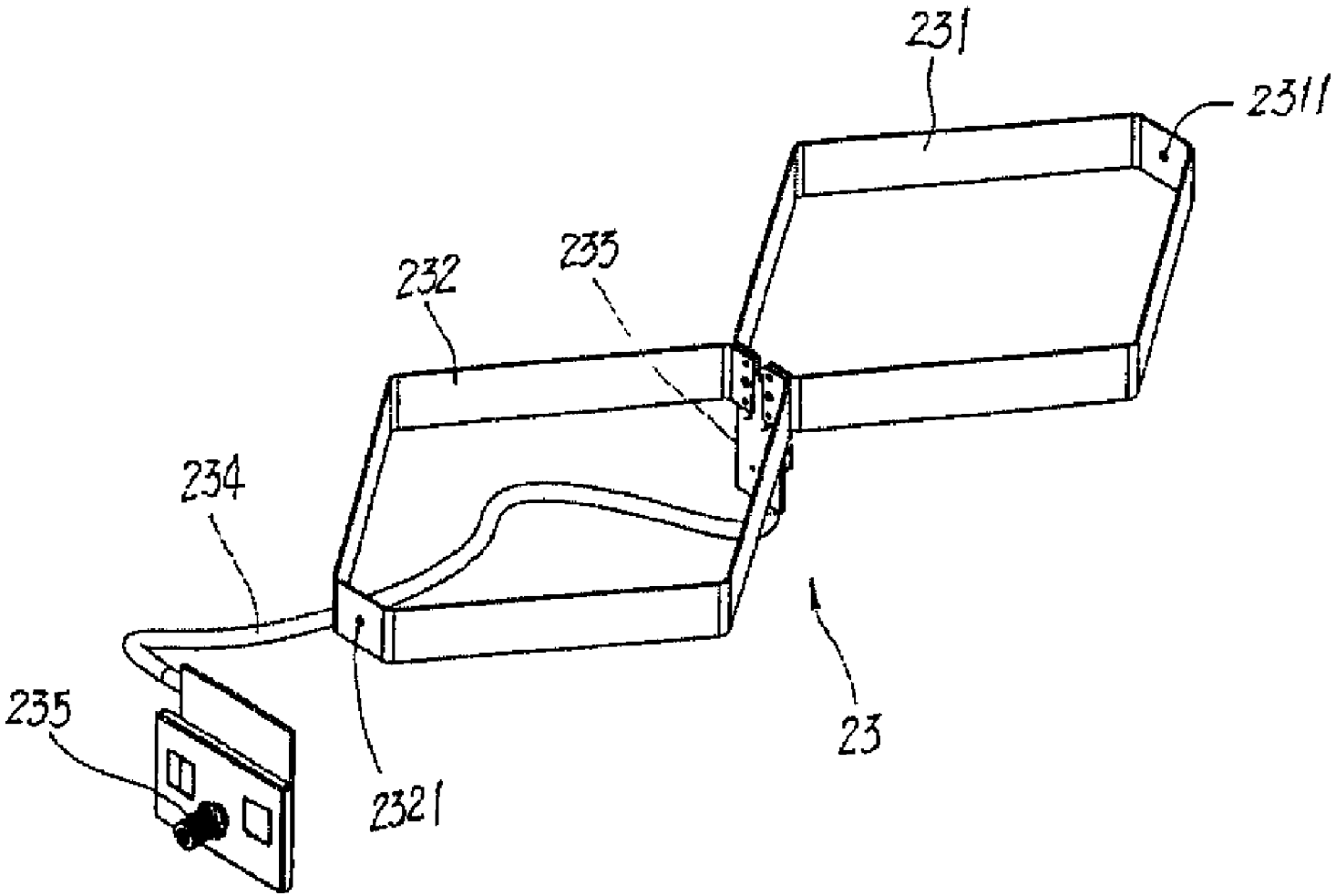
FIG. 5 is a perspective view showing a diamond-shaped antenna in accordance with the present invention.

As to the detailed structure of the reflection case 22, referring to FIG. 4, the reflection case 22 comprises reflection plates 221 arranged along a circumference thereof and on the bottom. The bottom is pre-processed by stamping to form the bent tabs 222, and the tabs 222 form positioning holes 2221. As to the diamond-shaped antenna 23, reference is made to FIG. 5. The diamond-shaped antenna 23 is composed of two quadrilateral antenna boards 231, 232 and adjacent portions of the quadrilateral antenna boards 231, 232 are joined through bolts or screws to form the central portion of the diamond-shaped antenna 23. Opposite upper and lower ends of the quadrilateral antenna boards 231, 232 form positioning holes 2311, 2321. The central joining portion is also coupled with the waveguide 233, which is in turn connected, through a cable 234, to a terminal member 235 that is connected to the connector 212 of the enclosure 21.

Figure 6:
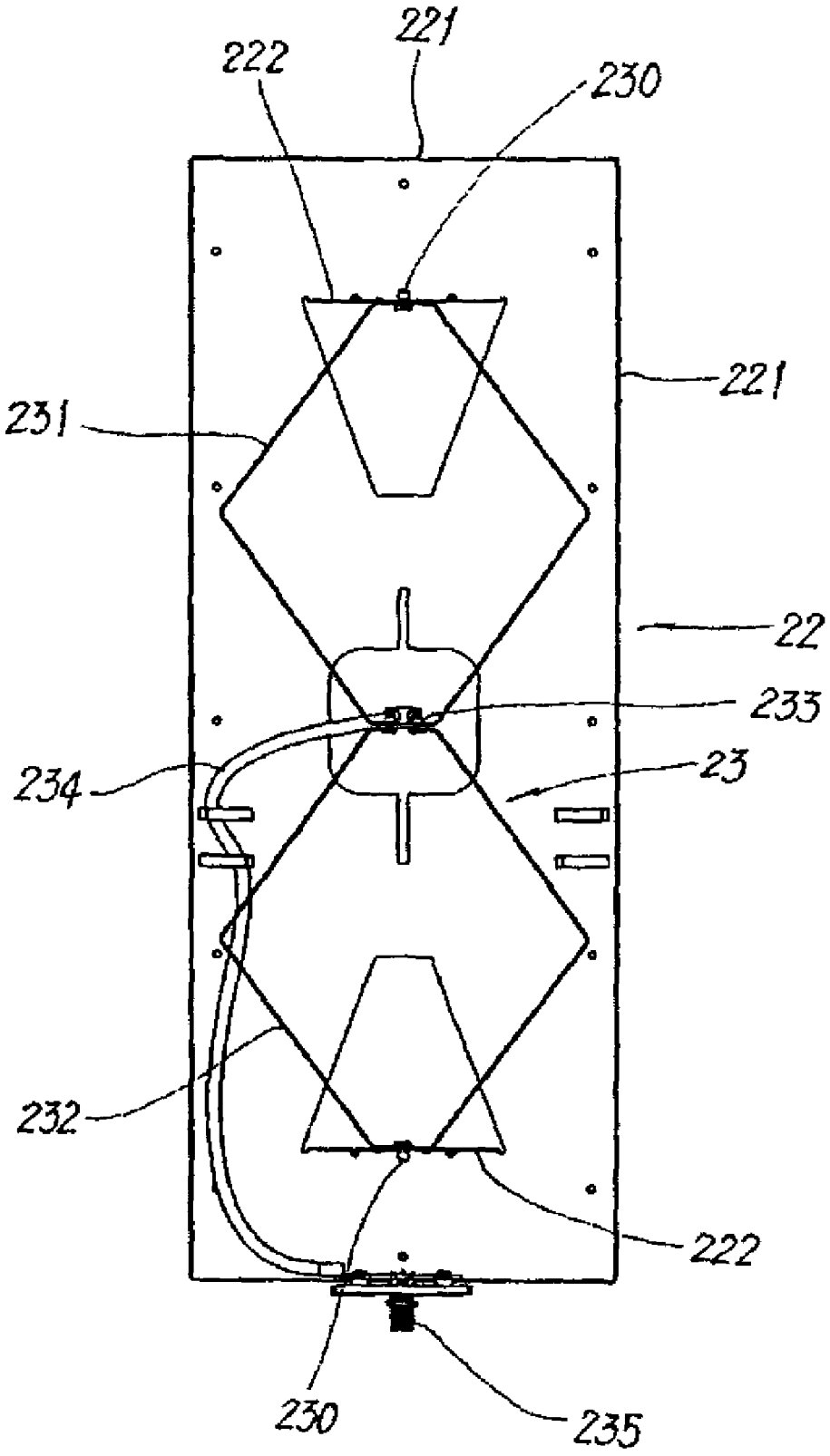
FIG. 6 is a schematic view illustrating the diamond-shaped antenna coupled to the reflection case in accordance with the present invention.

To couple the reflection case 22 and the diamond-shaped antenna 23 together, as shown in FIG. 6, the antenna boards 231, 232 are set to abut the bent tabs 222 and are fixed together with bolts 230. The joining portions of the antenna boards 231, 232 are coupled with the waveguide 233, which is connected through the cable 234 to the connector 235 that is fixed to an end wall of the reflection case 22 for connection with the connector 212 of the enclosure 21.

To use, as shown in FIG. 2, with the waveguide 233 (having impedance matching from 300Ω to 75Ω), electromagnetic wave signals are received. Due to the arrangement of the diamond-shaped antenna 23, the receiving angle (range) is made wider. With the arrangement of the reflection plates 221 of the reflection case 22, the signal can be collected and concentrated to provide excellent stability, and is particularly good in receiving UHF signal by providing a high gain. In other words, the arrangement of the diamond-shaped antenna 23 facilitates the receiving of signal and stability and also work with the enclosure 21 and the cover plate 24 to reliably enclose the diamond-shaped antenna 23 for water resistance, so that rains will not affect signal receiving or even damage the antenna device.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A diamond-shaped antenna receiving device comprising:

an enclosure which is a hollow container defining a receiving compartment and having a back to which a mounting seat is provided and an end forming a connector, said connector being fit with a water-proof sheath;

a reflection case received with said receiving compartment of said enclosure and having a circumference forming surrounding reflection plates and a bottom which is stamped to form partially cut line so as to define partially cut tabs, said tabs being bent upwardly by an angle of 90 degrees thereby forming openings in said bottom;

a diamond-shaped antenna which comprises two quadrilateral antenna boards and forms two positioning holes in opposite sides thereof for coupling with said bent tabs, said diamond-shaped antenna having a central portion where said quadrilateral antenna boads joined to each other and a waveguide is coupled to said central portion, said waveguide being connected to a terminal member through a cable; and a cover plate engaged with said enclosure.

2. The diamond-shaped antenna receiving device as claimed in claim 1, wherein said mounting seat is secured to said enclosure by bolting.

* * * * *